US006510586B1

(12) United States Patent
Ginzel

(10) Patent No.: US 6,510,586 B1
(45) Date of Patent: Jan. 28, 2003

(54) DOOR CLOSER

(75) Inventor: Lothar Ginzel, Hermannsbrunnen (DE)

(73) Assignee: Dorma GmbH + Co. KG, Ennepetal (DE)

( * ) Notice: Subject to any disclaimer, the term of this patent is extended or adjusted under 35 U.S.C. 154(b) by 0 days.

(21) Appl. No.: 09/661,412

(22) Filed: Sep. 13, 2000

Related U.S. Application Data

(63) Continuation-in-part of application No. PCT/EP00/00078, filed on Jan. 7, 2000.

(30) Foreign Application Priority Data

Jan. 14, 1999 (DE) ..... 199 01 035

(51) Int. Cl.[7] ..... E05F 1/08

(52) U.S. Cl. ..... 16/79; 16/53; 16/62; 16/378; 49/340; 49/386

(58) Field of Search ..... 19/79, 378, 49, 19/52, 53, 58, 64, 69, 62; 49/341, 386, 339, 340, 334, 336

(56) References Cited

U.S. PATENT DOCUMENTS

| | | | | |
|---|---|---|---|---|
| 3,396,424 A | | 8/1968 | Russell et al. | |
| 3,696,462 A | * | 10/1972 | Martin | 16/55 |
| 3,874,117 A | * | 4/1975 | Boehm | 49/340 |
| 4,744,125 A | * | 5/1988 | Scheck et al. | 16/53 |
| 4,763,385 A | * | 8/1988 | Furch et al. | 16/58 |
| 4,915,280 A | * | 4/1990 | Orill et al. | 16/79 |
| 5,048,151 A | * | 9/1991 | Orill et al. | 16/64 |
| 5,199,393 A | | 4/1993 | Baldassini | |
| 5,309,676 A | * | 5/1994 | Appelmann et al. | 16/64 |
| 5,417,013 A | * | 5/1995 | Tillmann | 16/56 |
| 5,850,671 A | * | 12/1998 | Kaser | 16/79 |
| 5,943,736 A | * | 8/1999 | Karkkainen et al. | 16/79 |
| 6,154,924 A | * | 12/2000 | Woo | 16/62 |
| 6,338,693 B1 | * | 1/2002 | Scholten et al. | 49/340 |

FOREIGN PATENT DOCUMENTS

| | | |
|---|---|---|
| DE | 929532 | 6/1955 |
| DE | 3327979 | 7/1984 |
| EP | 0856628 | 8/1998 |
| FR | 863706 | 8/1941 |
| FR | 1510056 | 12/1967 |

* cited by examiner

*Primary Examiner*—Chuck Y. Mah
(74) *Attorney, Agent, or Firm*—Nils H. Ljungman & Associates

(57) ABSTRACT

Door closer with a spring system that must be stretched when the door is open and supplies the closing moment necessary to close the door. There is provided a gear train between the spring system and the door to influence the force curve which varies over the opening angle of the door, whereby the gear train that varies in its translation ratio over the opening angle of the door has a first and a second gear wheel that mesh with each other and are each formed by a circular gear rim and are mounted eccentrically with respect to their centers while retaining the axial distance between them. The first gear wheel is connected with an output shaft and the second gear wheel is connected coaxially with respect to its center of motion with a gear wheel that is engaged in a rack that is coupled with the spring system. The axis of rotation of the output shaft runs through the center of motion of the first gear wheel, and all of the above elements are arranged so that the eccentricity e of the gear wheels that results from the center of a gear wheel and the center of motion is point-symmetric to their pitch point.

11 Claims, 5 Drawing Sheets

FIG. 3
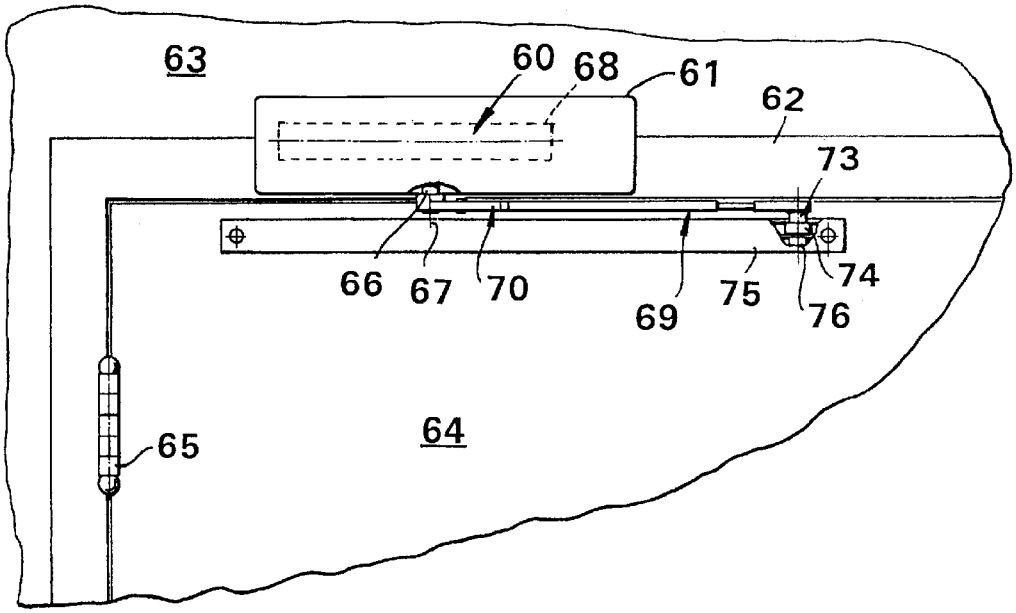
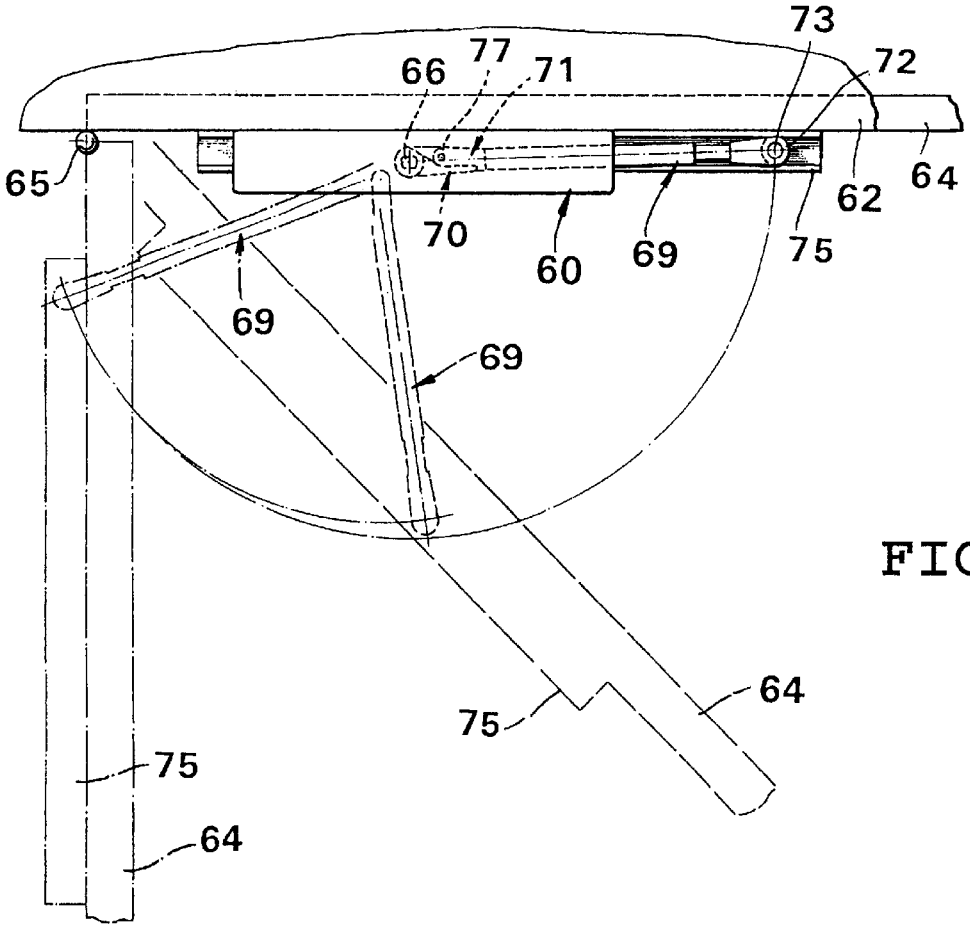
FIG. 4

DOOR CLOSER

CONTINUING APPLICATION DATA

This application is a Continuation-in-Part application of International Application No. PCT/EP00/00078, filed on Jan. 7, 2000 and claiming priority from Federal Republic of Germany Patent Application No. DE 199 01 035.8, filed on Jan. 14, 1999. International Application No. PCT/EP00/00078 was pending as of the filing date of the above-cited application. The United States was an elected state in International Application No. PCT/EP00/00078.

BACKGROUND OF THE INVENTION

1. Field of the Invention

This invention relates to a door closer. More particularly, this invention relates to a door closer which may be secured to a door or a door frame and which interacts with the door that is served by it.

2. Background Information

French Patent No. 1,510,056 discloses a door closer that is provided with a slide rail linkage. One end of an arm of the slide rail linkage is connected to the door closer that is located on the door panel, and the other end of the arm is mounted so that it slides in a rail on the door casing (came or frame). The door-closer-end side of the arm is connected with a drive shaft of a gear train that is coupled to a spring system. The gear train consists of specially shaped geared cam disks with a pitch profile that results from different segmentally constant radii of the geared cam disks.

The one geared cam disk is connected with the end of the arm by means of the output shaft of the door closer, and the other geared cam disk is connected with a pinion of the door closer that is engaged in a rack, which pinion moves the rack against or with the bias of a spring of the spring system.

When the door panel of the door is opened, this spring is stretched, which supplies the closing moment required to close the door. By means of the varying pitch curve of the two geared cam disks, the lever arm of the arm that varies with the opening angle of the door panel is counteracted, so that the torque required to open and close the door has a defined characteristic over the opening angle, in particular if the objective is to achieve a decreasing opening moment.

In practice it has been shown that the specially configured geared cam disks, with their pitch curve profiles that are different in each segment, are difficult, time-consuming and expensive to manufacture and require special gearing geometries.

These special gearing geometries must also be different for all geared cam disk combinations and for all geared cam disk configurations, as a function of the radii that change from one segment to the next. These configurations are extremely difficult, time-consuming and expensive to manufacture.

European Patent No. 0 856 628 A1 discloses a door closer, the drive shaft of which is connected with an eccentrically mounted gear wheel. This gear wheel meshes with its gear teeth in a gearing area that runs in a straight line and at an angle and is located inside a piston that interacts with a spring. As the drive shaft rotates, the resulting lever arms therefore have different effective lengths. Therefore the force and torque curve also changes.

OBJECT OF THE INVENTION

The object of the invention is to improve a door closer as described above so that, while avoiding the disadvantages described above, a simple, space-saving construction is achieved that can easily be designed to achieve the desired torque curves over the opening angle of the door panel.

SUMMARY OF THE INVENTION

The invention teaches that this object can be accomplished as disclosed in a particularly simple manner using substantially standard gear wheels in a gear train according to one aspect of the invention.

The dependent claims describe additional advantageous embodiments of the invention.

The invention teaches that the force-torque curve that varies over the opening angle of the door, both during the opening and closing, can be influenced by means of a device that has a translation ratio that varies over the opening angle, which effect is achieved by eccentrically located gear wheels that have a circular gear rim and can be manufactured easily and economically.

The invention therefore teaches that the gear train, which has a translation ratio that varies over the opening angle of the door, has a first and a second gear wheels that mesh with each other, and each of these gear wheels is realized in the form of a circular gear rim, and which, while retaining their axial distance from each other, are mounted eccentrically with respect to their centers, and the first gear wheel of which is connected with an output shaft and the second gear wheel of which is connected coaxially with the center of motion with the gear wheel that is engaged with the rack that is coupled with the spring system, whereby the axis of rotation of the output shaft runs through the center of motion of the first gear wheel, and all of the above elements are arranged so that the eccentricity of the gear wheels that results from the center of a gear wheel and the new center of motion is point-symmetric to their pitch point.

The invention teaches a simple method to determine the torque curves by a choice of the eccentricity, the pitch circle diameter and the resulting distance between the axes of rotation of the two gear wheels. The result is a wide range of potential translation ratios and thus potential adaptations to desired torque characteristics over the opening angle of the door, without requiring specially fabricated geared cam disks. Instead, the invention teaches that it is possible to use commercially available gear wheels, which significantly reduces fabrication costs. The gear wheels can also have a standard gearing.

In other words, gear wheels with standard gear teeth can be used in one embodiment of the invention.

The magnitude of the eccentricity is described by the ratio of the eccentricity to the base diameter. In particular, this ratio should not exceed a value of 0.137 for gearings that are in compliance with DIN (German Industrial Standard) 867.

In one embodiment of the invention, the door closer a is realized in the form of a top-mounted door closer, with an effective lever arm that varies over the range of rotation between a first connection point of the rotational door panel of the corresponding door and an additional connecting point outside the door panel, which lever arm is engaged with the output shaft.

Thus, the door closer may be mounted at the top of the door frame or similarly near the ceiling structure where the door is installed.

The effective lever arm is preferably formed by a slide rail linkage or a toggle linkage.

Alternatively, the door closer can also be realized in the form of a floor-mounted (or bottom-mounted) door closer, in which the output shaft interacts with the bearing of the door panel.

The above-discussed embodiments of the present invention will be described further hereinbelow with reference to the accompanying figures. When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

DESCRIPTION OF THE DRAWINGS

Additional advantages and characteristics of the invention are described in greater detail below, with reference to exemplary embodiments that are illustrated in the accompanying drawing, in which.

FIG. 3 is an elevation of a door closer with a slide rail linkage;

FIG. 4 is a top plan view of the assembly of FIG. 3;

DESCRIPTION OF THE PREFERRED EMBODIMENTS

Figure 1:
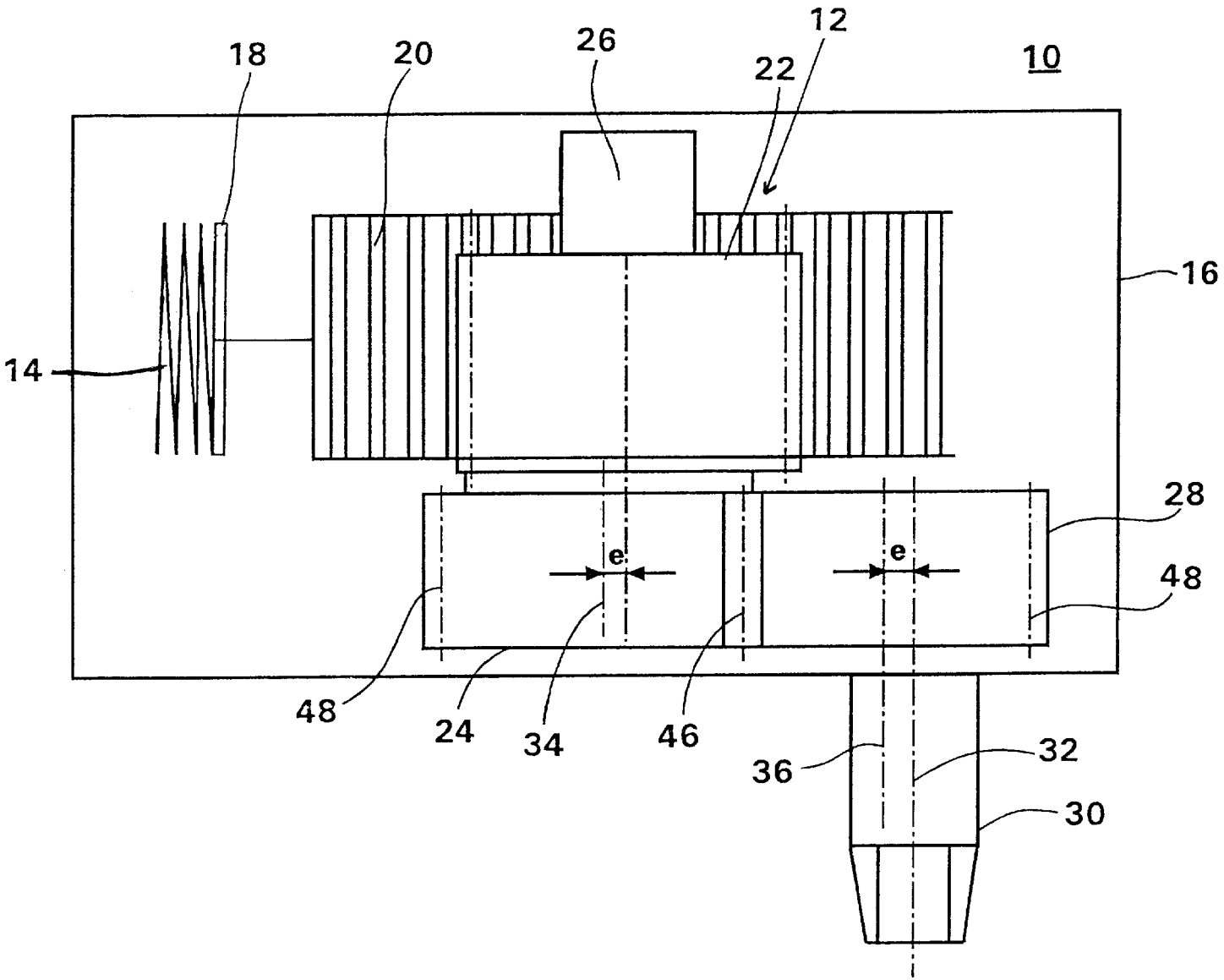
FIG. 1 is a schematic view (detail) of the gear train of the door closer.

FIG. 1 is a schematic view of a door closer 10 with the gear train 12 and spring system 14, which are located in a housing 16 of the door closer 10.

The spring 14 is coupled to a rack 20 in the manner of the prior art by means of a piston 18 that is guided in the housing 16. Engaged in the rack 20 is a gear wheel 22 which is non-detachably connected with a gear wheel 24, whereby the axis of rotation 26 of the gear wheel 22 and the axis of rotation of the gear wheel 24 are identical.

The gear wheel 24 meshes with an additional gear wheel 28 which is connected with an output shaft 30 that projects out of the housing 16. The output shaft 30 is located coaxially to the axis of rotation 32 of the gear wheel 28.

In other words, in one embodiment of the present invention as illustrated in FIG. 1, the axis of rotation 32 of the output shaft 30 is located offset by the eccentricity e to the center axis 36 of gear wheel 28. The two gear wheels 24 and 28 are provided with standard gearing and are mounted so that they rotate eccentrically with respect to their respective center axes 34 and 36 by a defined amount e. The axis of rotation 26 of the gear wheel 24 is therefore always separated from its center axis 34 by the distance e, and likewise the axis of rotation 32 of the gear wheel 28 is always separated from its center axis 36 by the distance e.

A toggle linkage or a slide rail linkage can be engaged with the output shaft 30 in the manner of the prior art. The door closer 10, however, can also be realized in the form of a floor-mounted door closer, in which case the output shaft 30 then interacts with a bearing that is not shown here in this embodiment of the invention.

Figure 2:
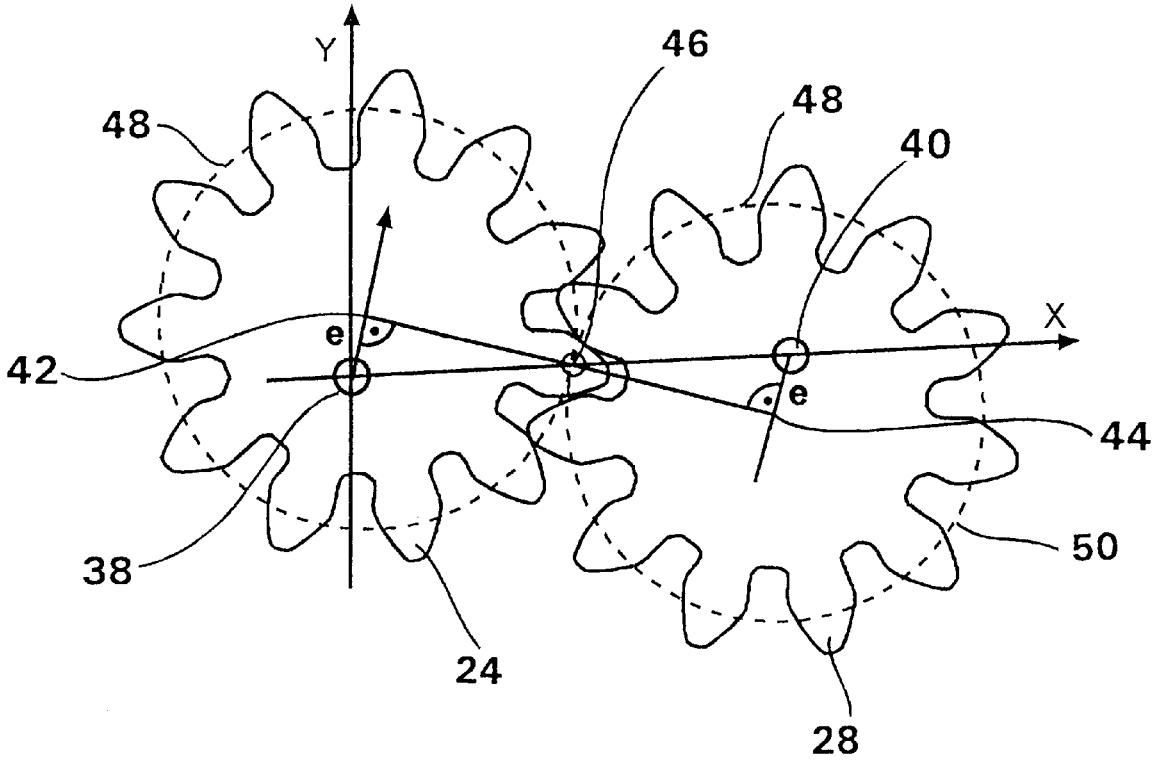
FIG. 2 shows the two gear wheels of the gear train illustrated in FIG. 1, with regard to the position of the centers of motion and the centers thereof.

FIG. 2 shows the gear wheels 24 and 28 meshed with each other in connection with an X-Y coordinate system, whereby the X-axis connects the two centers of motion 38 and 40 to each other by (through) the axes of rotation 26 and 32. The centers 42 and 44 formed by the center axes 34 and 36 are each separated from the corresponding centers of-motion 38 and 40 respectively by the distance e which defines the eccentricity. The centers 42 and 44 relate to a circular gear rim of the respective gear wheel 24 or 28 that has a circular root circle, tip circle, pitch circle and the like parameters to configure gear wheels.

In other words, with reference to FIG. 2 the X-axis connects the two centers of motion 38 and 40 to each other, which centers-of motion 38 and 40 are coincidental with the axes of rotation 26 and 32, when considered in the top plan view of FIG. 1.

Also in other words, in FIG. 2 with respect to gear wheel 24, the eccentricity e is the length of the short leg of the rectangular triangle in which the other short leg of the triangle is the length of the radius of the pitch circle 48. The length of the hypotenuse of this triangle extends between the center of motion 38 and the pitch point 46 of the pitch circles 48 and 50.

With respect to gear wheel 28, the eccentricity e is the length of the short leg of the rectangular triangle in which the other short leg of the triangle is the length of the radius of the pitch circle 50. The length of the hypotenuse of this triangle extends between the center of motion 40 and the pitch point 46 of the pitch circles 48 and 50.

Further in other words, the two triangles are symmetric about pitch point 46 in that the two hypotenuses extend symmetrically along the X-axis, respectively in this instance of depicted motion from the center of motion 38 to pitch point 46, and from pitch point 46 to the center of motion 40.

As shown clearly in FIG. 2, the eccentricity e formed by the center 42 and the center of motion 38 and by the center 44 and the center of motion 40 is point-symmetric to the pitch point 46 of the two meshing gear wheels 24 and 28, because the two pitch circles 48 and 50 of the gear wheels 24 and 28 touch each other.

The gear wheels 24 and 28 have corresponding shapes. This configuration makes it possible that, when the gear wheels 24 and 28 rotates the distance from the center of motion 38 to the pitch point 46 can increase or decrease by the dimension by which the distance between the center of motion 40 and the pitch point 46 decreases or increases respectively. However, the distance between the centers of motion 38 and 40 of the two gear wheels 24 and 28 thereby remains constant during the rotation of the gear wheels 24 and 28.

The result is a simple method to vary the translation ratio with the rotation of the gear wheels 24 and 28 and thus of the output shaft 30. Over the opening angle of a door panel of a door, therefore, it becomes possible in a simple manner to influence the effective lever arm, which varies as a function of a sliding rail linkage of a top-mounted door closer, for example, and thus to influence the force and torque curve which varies over the opening angle. Depending on the eccentricity and pitch circle diameter, the translation ratio can easily be adapted to predetermined torque characteristics.

In other words, the transmission ratio can readily be adapted to preselected torque characteristics as a function of the eccentricity and the pitch circle diameter.

In one embodiment, the base circle (or base cylinder) is the circle from which the involute tooth profiles are generated. The relationship between the base circle and the pitch circle diameter can then be Db=D cos. q, where Db=base circle diameter, D=pitch circle diameter, and q=the pressure angle.

FIGS. 3 and 4 are copies of the FIGS. 1 and 2 from U.S. Pat. No. 4,102,005, having the title "Door closer arm", having the inventors Schnarr et al., filed on Jul. 5, 1977, and issued on Jul. 25, 1978, from which copies of which figures all of the reference numerals present in the original figures, as they appear in U.S. Pat. No. 4,102,005, have been removed. U.S. Pat. No. 4,102,005 is hereby incorporated by reference as if set forth in its entirety herein. The reference numerals that have been removed from the figures for this U.S. patent, essentially reproduced herein as FIGS. 3 and 4, indicate structures and arrangements that are well known in the prior art.

In one possible embodiment of the present invention illustrated in FIGS. 3 and 4 there is shown a door closer 60 mounted with its housing 61 on the door frame 62 of a typical type of door disposed in a wall 63 having an opening in which a door panel 64 is disposed, the door panel 64 being mounted by hinges such as 65 for free-swinging movement toward and away from the door frame 62.

The door closer 60 serves to insure that the door panel 64 is automatically swung into the closed position after a manual opening movement by means of the transmission arrangement described in the foregoing. The door closer 60 incorporates an output shaft 66 which is rotatable about a vertical axis 67 subject to the force of a spring (such as spring 14 mentioned above) in conformity with the preceding description. The door closer 60 may include a hold-open device 68, as is known in the art.

Secured to the shaft 66 which projects from the housing 61 is an arm generally identified by reference numeral 69 and which serves to interconnect the output shaft 66 with the relatively moving panel 64. The arm 69 can be made up of several parts, particularly including an arm base 70 which is suitably secured to the shaft 66, such that the output shaft 66 and the arm base 70 always move together. The arm base 70 is augmented by an arm extension 71 generally included in the arm 69, and the arm extension 71 terminates in a boss 72. The boss 72 carries a shaft 73 having a roller 74 thereon operable in a generally straight channel 75 or the like guide, track or the like device which allows a sliding movement, disposed on the door panel 64.

It is understood that the channel 75 and the closer 60 can be reversed in their mounting location, but their interactions remain the same in either instance.

The roller 74 is freely movable longitudinally in the track or channel 75, but a friction shoe 76 may be included in the assembly to afford some braking restraint when the door is in an intermediate position.

Movement of the door panel 64 is particularly evident from FIG. 4. Thus, when the door panel 64 is moved into an open position the spring, such as spring 14 mentioned above, in the closer 60 is brought to its energized condition by the gear transmission as described above. The roller 74 slides freely in the channel 75 because the arm extension 71 is freely pivotable about the pivot 77.

Figure 5:
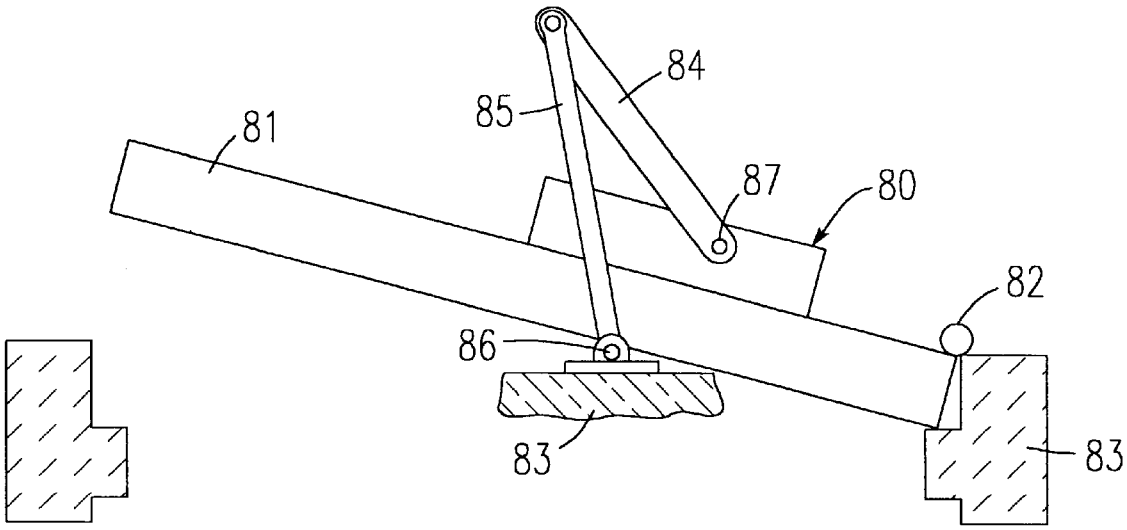
FIG. 5 is a top plan view of a door closer mounted on a door panel and showing the open position of the door.
Figure 6:
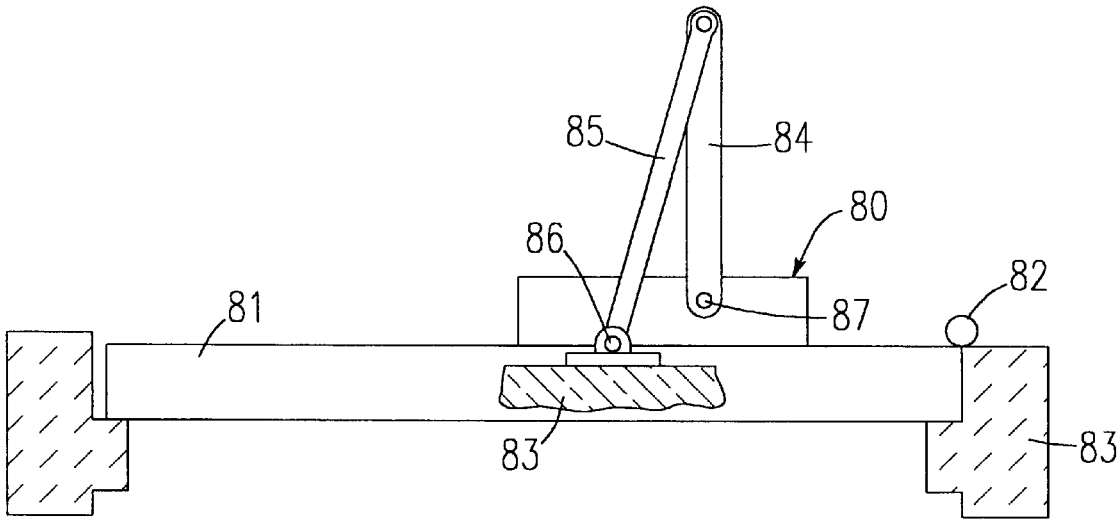
FIG. 6 is a top plan view according to FIG. 5 and showing the door in the closed position.

FIGS. 5 and 6 are copies of FIG. 1 from U.S. Pat. No. 3,396,424, having the title "Door closer", having the inventors Russell et al., filed on Jun. 19, 1967, and issued on Aug. 13, 1968, from which copy of which figure all of the reference numerals present in the original figure, as it appears in U.S. Pat. No. 3,396,424, have been removed. U.S. Pat. No. 3,396,424 is hereby incorporated by reference as if set forth in its entirety herein. The reference numerals that have been removed from the figure for this U.S. patent, essentially reproduced herein as FIGS. 5 and 6, indicate structures and arrangements that are well known in the prior art.

In one possible embodiment of the present invention, illustrated in FIGS. 5 and 6, a door closer 80 is mounted directly on a door 81. The door 81 is mounted so as to swing on or about hinges 82 in a door frame 83.

There are provided a first closing arm 84 which is connected with one end to the closer 80 and its other end is pivotally connected to a second closing arm 85 which, in turn, is pivotally connected to a bracket or pivot 86. Thus, the closing arms 84 and 85 are mounted such that the closing arm 85 is attached by way of a bracket or the like pivot 86 to the door frame 83.

The open condition of the door 81 is indicated in FIG. 5 and the closed condition is indicated in FIG. 6.

Based on the description hereinabove, it will be clear that the rotary motion of the output shaft 87 of the door closer 80 will move the door, due to the intervening linkage comprised of the two closing arms 84 and 85, to the closing position.

Figure 7:
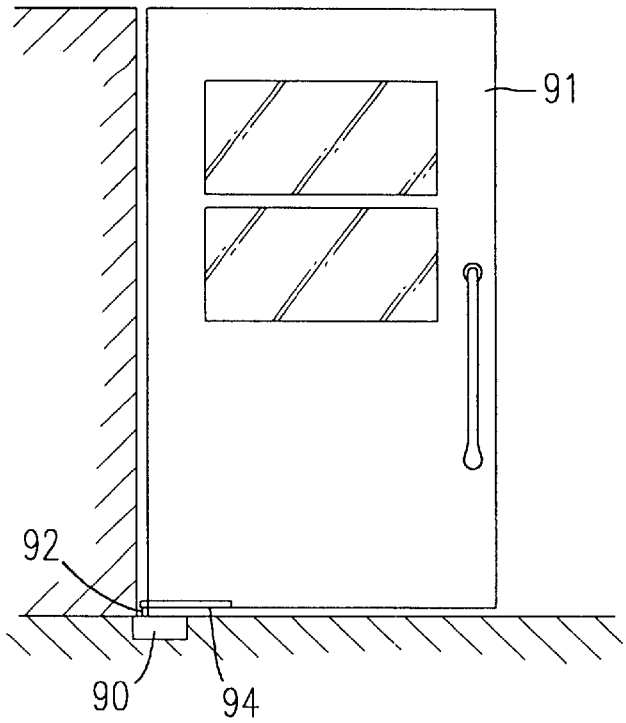
FIG. 7 is an elevation showing a bottom-mounted door closer.
Figure 8:
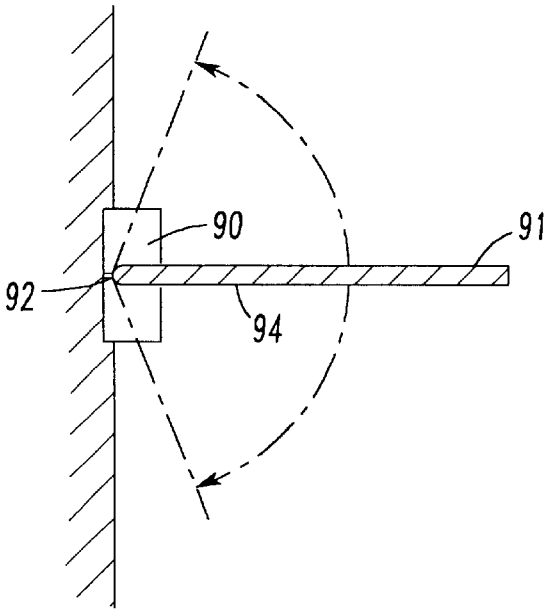
FIG. 8 is a top plan view according to FIG. 7.
Figure 8A:
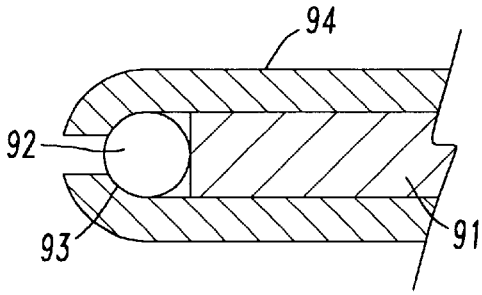
FIG. 8A is a detail showing the connection of the output shaft of the door closer to the door hardware.

FIGS. 7 and 8 are copies of the FIGS. 1 and 2 from German Patent No. DE 929,532, having the German title "Selbstaetiger Tuerachliesser", having the inventor Junghans, filed in Germany on Jun. 10, 1952, and laid open Jan. 5, 1955, from which copies of which figures all of the reference numerals present in the original figures, as it appears in German Patent No. DE 929,532, have been removed. German Patent No. DE 929,532 is hereby incorporated by reference as if set forth in its entirety herein. The reference numerals that have been removed from the figures for this German Patent, essentially reproduced herein as FIGS. 7 and 8, indicate structures and arrangements that are well known in the prior art.

In one possible embodiment of the present invention, illustrated in FIGS. 7 and 8, the present invention includes a swing door 91, i.e., the door 91 can be swung about its axis of rotation 92 inwardly or outwardly. In this embodiment, the door closer 90 is floor-mounted or bottom-mounted near the pivot or axis of rotation 92, and the output shaft 93 can form part of the hinge apparatus. Brackets 94 secured to the door 91 can provide the hardware connection between the door 91 and the output shaft 93, thereby to providing a bearing allowing swinging or rotating movement of the door 91.

Instead of the shown spring assembly, such as spring assembly 14 as is generally shown in FIG. 1, other spring arrangements can be made and other tension or force producing mechanisms can be employed in other embodiments of the invention. Thus, pneumatic or hydraulic or other devices can be used with the gear train 12, as is known in the art as mentioned hereinbelow.

One feature of the invention resides broadly in the door closer 10 with a spring system 14 that must be stretched when the door is open and supplies the closing moment necessary to close the door, and with a gear train 20 to 28 between the spring system 14 and the door to influence the force curve which varies over the opening angle of the door, whereby the gear train 20 to 28 that varies in its translation ratio over the opening angle of the door has a first and a second gear wheel 24, 28 that mesh with each other and are each formed by a circular gear rim and are mounted eccentrically with respect to their centers 42, 44 while retaining the axial distance between them, and the first gear wheel 28 of which is connected with an output shaft 30 and the second gear wheel 24 of which is connected coaxially with respect to its center of motion 38 with a gear wheel 22 that is engaged in a rack 20 that is coupled with the spring system 14, whereby the axis of rotation 32 of the output shaft 30 runs through the center of motion 40 of the first gear wheel 28, and all of the above elements are arranged so that the eccentricity e of the gear wheels 24, 28 that results from the center 42, 44 of a gear wheel 24, 28 and the center of motion 38, 40 is point-symmetric to their pitch point 46.

Another feature of the invention resides broadly in the door closer characterized by the fact that the two gear wheels 24, 28 have a shape that corresponds to each other.

Yet another feature of the invention resides broadly in the door closer characterized by the fact that the gear wheels 24, 28 have a standard gearing.

Still another feature of the invention resides broadly in the door closer characterized by the fact that for gearings in compliance with DIN (German Industrial Standard) 867, the ratio of the magnitude of the eccentricity to the base diameter is not greater than 0.137.

A further feature of the invention resides broadly in the door closer characterized by a realization in the form of a top-mounted closer with an effective lever arm that varies between a connection point of the movable door panel of the corresponding door and an additional connection point outside the door panel over the range of rotation, and is engaged with the output shaft 30.

Another feature of the invention resides broadly in the door closer characterized by the fact that the effective lever arm is formed by a slide rail linkage.

Yet another feature of the invention resides broadly in the door closer characterized by the fact that the effective lever arm is formed by a toggle linkage.

Still another feature of the invention resides broadly in the door closer characterized by a realization in the form of a floor-mounted door closer, in which the output shaft 30 interacts with the bearing of the door panel.

A further feature featured of the invention resides broadly in a mechanical door closer for a door supported by a door supporting frame to swing about an axis or rotation, said door closer comprising: a housing adapted to be connected to one of: said door and said door supporting frame; at least one spring disposed in said housing, said at least one spring being configured to be stretched when the door is open, and said at least one spring supplying the closing moment to close the door; a gear train system disposed in said housing, said gear train system is configured to provide a force output which varies as a function of the opening angle of the door, and said gear train system comprises: a toothed gear rack operatively connectable to said at least one spring; a pinion gear wheel, said pinion gear wheel is journalled in said housing, said pinion gear wheel has a longitudinal axis of rotation, and said pinion gear wheel is configured to mesh with said toothed gear rack so as to rotate about its longitudinal axis of rotation; a first gear wheel, said first gear wheel is journalled in said housing, and said first gear wheel is mounted face-parallel with respect to said pinion gear wheel and eccentrically with respect to said longitudinal axis of revolution of said pinion gear wheel; a second gear wheel, said second gear wheel is journalled in said housing, and said second gear wheel is configured to mesh with said first gear wheel; an output shaft having rotary output from said second gear wheel to actuate said door; said output shaft and said second gear wheel being disposed eccentrically with respect to one another in an eccentricity which is commensurate with the eccentricity between said pinion gear wheel and said first gear wheel; and at least one linkage configured to bridge across said door and said door supporting frame, said linkage is operatively connectable to said output shaft to actuate said door in conformity with the rotation of said output shaft.

Another feature of the invention resides broadly in a door closer comprising: apparatus configured to produce at least linear force; a transmission system connected to said apparatus configured to produce at least linear force, said transmission system having a gear mechanism configured to convert linear force into torque; a first gear wheel having a longitudinal axis, a center of motion, and a pitch circle about its center; an output shaft having an axis of rotation, said axis of rotation of said output shaft is eccentrically disposed by an eccentricity with the magnitude a with respect to said longitudinal axis of said first gear wheel; and a second gear wheel having a longitudinal axis, a center of motion, and a pitch circle about its center, said longitudinal axis of said second gear wheel is eccentrically disposed by an eccentricity with the magnitude e with respect to said gear mechanism; said first and second gear wheels being configured to meshingly engage with one another in a pitch point produced at the point of tangency of the pitch circles of said first and second gear wheels; with the eccentricity e being formed by the center and the center of motion of said second gear wheel and by the center and the center of motion of said first gear wheel being substantially symmetric when considered at said pitch point of said first and second meshing gear wheels.

Yet another feature of the invention resides broadly in a door closer that controls the opening and closing swing of a door mounted by a door frame, said door closer comprising: a housing; at least one spring disposed in said housing, said at least one spring being configured to be tensioned when said door is open, and said at least one spring supplying the closing force to close said door; a gear transmission in said housing, said gear transmission being configured to provide a force output in conformity with the output of force by said at least one spring, whereby the force output of said gear transmission varies as a function of the opening angle of the door, and said gear transmission includes: a rack and pinion apparatus; a first gear wheel; said first gear wheel is journalled in said housing, and said first gear wheel is mounted face-parallel with respect to the pinion of said rack and pinion apparatus and eccentrically with respect to the longitudinal axis of revolution of said pinion; a second gear wheel journalled in said housing and disposed and configured to mesh with said first gear wheel; and an output shaft having rotary output from said second gear wheel for control of movement of said door; said output shaft and said second gear wheel being disposed eccentrically with respect to one another in an eccentricity which in commensurate with the eccentricity between said pinion gear wheel and said first gear wheel.

Still another feature of the invention resides broadly in a door closer for a pivot-hung door drive system with a spring system being configured and disposed to be stretched upon the door being opened and also supplying a closing moment required to close a connected pivot-hung door panel, said door closer comprising:

a transmission arrangement arrangement;

a linkage configured and disposed to move a door panel, said linkage being connected to said transmission arrangement and said linkage being configured and disposed to be driven by said transmission arrangement;

said transmission arrangement comprising an input arrangement and an output arrangement;

said input arrangement being connected to said drive arrangement;

said output arrangement being connected to said linkage; and said transmission arrangement comprising at least two gear wheels being configured and disposed to change the relationship between the movement of said input arrangement and said output arrangement dependent upon the position and angle of rotation of one of said input arrangement and said output arrangement to provide differences in the opening and closing moments of said output arrangement over rotation of a door panel dependent upon the position of said output arrangement and the angle of rotation of said output arrangement to minimize force provided by said drive arrangement to close a door.

said transmission arrangement comprising a spring system operably connected to said at least two gear wheels to supply a closing moment to close a connected door.

A further feature of the invention resides broadly in the door closer wherein:

said input arrangement has an angle of movement;

said output arrangement has an angle of movement; and one of said at least two gear wheels being configured to change the relationship between the movement of said input arrangement and another of said at least two gear wheels of said output arrangement comprises at least one gear wheel to change the angle of movement of said output arrangement and the angle of movement of said input arrangement to provide different translation ratios between said input arrangement and said output arrangement dependent upon a position of said output arrangement within the angle of movement of said output arrangement.

Another feature of the invention resides broadly in the door closer wherein:

said at least two gear wheels comprise a first gear wheel and a second gear wheel;

said first gear wheel is configured and disposed to engage with said second gear wheel to provide different translation ratios between said input arrangement and said output arrangement dependent upon a position of said output arrangement within the angle of movement of said output arrangement;

said gear wheels are configured and disposed to be engaged with one another substantially constantly throughout 360° of rotation of said gear wheels;

each of said gear wheels comprises a curvilinear gear rim;

each of said gear wheels has a geometric center point;

each of said gear wheels has an axis of rotation about which each of said gear wheels rotates;

each of said gear wheels is mounted at the axis of rotation;

each of said axes of rotation is disposed a substantial predetermined distance from its corresponding geometric center point;

said output arrangement comprises an output shaft;

said output shaft is connected to said second gear wheel;

said output shaft is disposed coaxially with respect to the axis of rotation of said second gear wheel;

said drive arrangement comprises a drive gear and a rack meshing with said drive gear;

said spring system connected to said rack to provide a closing moment;

said drive gear is configured and disposed to operatively connect to said first gear wheel; and said drive gear is disposed coaxially with respect to the axis of rotation of said first gear wheel.

Yet another feature of the invention resides broadly in the door closer wherein:

each of said gear wheels has a corresponding pitch circle disposed about said axis of rotation;

said pitch circle of said first gear wheel is disposed to intersect substantially tangentially with said pitch circle of said second gear wheel;

said intersection of said pitch circles forms a pitch point;

each said axis of rotation and its corresponding geometric center point are configured and disposed to provide an eccentricity; and each of said geometric center points of each of said gear wheels lies centrically symmetric to the pitch point to produce eccentricity.

Still another feature of the invention resides broadly in the door closer wherein:

said door closer is a top-mounted door closer; and said top-mounted door closer comprises:

a lever arm;

said lever arm is configured and disposed to effectively vary over the range of rotation between a coupling point of a door panel and another coupling point outside a door panel; and said lever arm is engaged with the output shaft.

Another feature of the invention resides broadly in the door closer wherein said lever arm is formed by a slide-rail linkage.

Yet another feature of the invention resides broadly in the door closer wherein said lever arm is formed by a toggle-lever linkage.

Still another feature of the invention resides broadly in the door closer wherein:

said pivot-hung door closer comprises an underfloor door closer; and said output shaft is configured and disposed to interact with a bearing of a door panel.

A further feature of the invention resides brroadly in the door closer wherein:

each of said gear wheels has a standard gearing according to DIN 867; and the ratio of the magnitude of the eccentricity provided by the predetermined distance between the geometric center points and the axes of rotation to the base circle diameter is not substantially greater than 0.137.

The copending U.S. patent application Ser. No. 09/482,363, having attorney docket No. NRL-DOR-65, a filing date of Jan. 13, 2000, the title "Pivot-Hung Door Drive", inventors Jan Scholten and Peter Kisters, and assignee DORMA GmbH+Co. KG, Ennepetal, Federal Republic of Germany, and which claims priority from Federal Republic of Germany Patent Application No. 199 01 229.6, filed on Jan. 14, 1999, is hereby incorporated by reference as if set forth in its entirety herein.

Examples of prior art gear mechanisms of which features may be used in embodiments of the present invention may be found in the following U.S. Pat. Nos. 3,934,307, issued Jan. 27, 1976 to Lassier et al.; U.S. Pat. No. 4,010,572, issued Mar. 8, 1977 to Peterson; U.S. Pat. No. 4,030,638, issued Jun. 21, 1977 to Lanno; U.S. Pat. No. 4,286,411, issued Sep. 1, 1981 to Wikkerink et al.; U.S. Pat. No. 4,348,835, issued Sep. 14, 1982 to Jones et al.; U.S. Pat. No. 4,501,090, issued Feb. 26, 1985 to Yoshida et al.; U.S. Pat. No. 4,590,639, issued May 27, 1986 to Fritsche et al.; U.S. Pat. No. 4,686,739, issued Aug. 18, 1987 to Fritsche et al.; U.S. Pat. No. 4,744,125, issued May 17, 1988 to Scheck et al.; U.S. Pat. No. 4,763,385, issued Aug. 16, 1988 to Furch et al.; U.S. Pat. No. 4,916,267, issued Apr. 10, 1990 to Lassier et al.; U.S. Pat. No. 4,973,894, issued Nov. 27, 1990 to Johansson; U.S. Pat. No. 4,979,261, issued Dec. 25, 1990 to Lassier et al.; U.S. Pat. No. 5,187,835, issued Feb. 23, 1993 to Lee; U.S. Pat. No. 5,206,971, issued May 4, 1993 to Schmelzer et al.; U.S. Pat. No. 5,239,778, issued Aug. 31, 1993 to Towler; U.S. Pat. No. 5,309,676, issued May 10, 1994 to Appelmann et al.; U.S. Pat. No. 5,488,896, issued Feb. 6, 1996 to Current; U.S. Pat. No. 5,535,514, issued Jul. 16, 1996 to Lucas; U.S. Pat. No. 5,809,697, issued Sep. 22, 1998 to Chen; U.S. Pat. No. 5,850,671, issued Dec. 22, 1998 to Käiser.

Examples of linkages including slide rails or the like, channels or track elements which may be used in embodiments of the present invention may be found in U.S. Pat. No. 4,102,005, issued Jul. 25, 1978 to Schnarr et al., also referred to above and below, and in French Patent No. 1,510,056, also referred to above and below. Examples of toggle linkages which may be used in embodiments of the present invention may be found in the following U.S. Pat. Nos. 4,102,005, issued Jul. 25, 1978 to Schnarr et al., also referred to above; U.S. Pat. No. 4,369,545, issued Jan. 25, 1983 to Maublanc; U.S. Pat. No. 4,386,446, issued Jun. 7, 1983 to Zunkel et al.; U.S. Pat. No. 4,656,690, issued Apr. 14, 1987 to Katagiri et al.; U.S. Pat. No. 5,749,122, issued May 12, 1998 to Herbst; U.S. Pat. No. 5,864,134, issued Jan. 26, 1999 to Burgess.

An example of a hold-open device which may be used in embodiments of the present invention may be found in U.S. Pat. No. 3,696,462 to Martin.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The following patents, patent applications, or patent publications, which were cited in the PCT Search Report dated Apr. 6, 2000, and/or cited elsewhere are hereby incorporated by reference as if set forth in their entirety herein as follows: French Patent No. 1,510,056, filed on Apr. 1, 1968; German Patent No. 33 27 979 C1, filed on Jul. 26, 1984; U.S. Pat. No. 5,199,393, filed on Apr. 6, 1993; French Patent No. 863, 706, filed on Apr. 8, 1941; U.S. Pat. No. 3,396,424, filed on Aug. 13, 1968; and German Patent No. 929,532, filed on Jun. 27, 1955.

The corresponding foreign and international patent publication applications, namely, Federal Republic of Germany Patent Application No. 199 01 035.8, filed on Jan. 14, 1999, having inventor Lothar Ginzel, and DE-OS 199 01 035.8 and DE-PS 199 01 035.8 and International Application No. PCT/EP00/00078, filed on Jan. 7, 2000, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses, if any, are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A door closer for a connected pivot-hung door, said door closer comprising:

a spring being configured and disposed to be stretched to store energy upon opening of a connected pivot-hung door;

said spring being configured to supply a closing force to close the connected pivot-hung door;

a transmission arrangement;

a linkage being configured to connect said transmission arrangement to the connected pivot-hung door and being configured to move the connected pivot-hung door;

said transmission arrangement being configured and disposed to connect said spring to said linkage to permit transfer of force from said linkage to said spring to store energy in said spring upon opening of the connected pivot-hung door, and to permit transfer of force from said spring to said linkage to move said linkage upon closing of the connected pivot-hung door; and said transmission arrangement comprising:

a shaft being connected to said linkage;

a first transmission gear wheel being connected coaxially to said shaft;

a second transmission gear wheel being engaged in mesh with said first transmission gear wheel substantially constantly throughout rotation of each of said transmission gear wheels;

said first transmission gear wheel comprising:

a circular gear rim;

a geometric center point;

gear teeth being disposed on said circular gear rim and being symmetrically disposed with respect to said geometric center point;

an axis of rotation about which said first transmission gear wheel rotates;

said first transmission gear wheel being mounted at said axis of rotation; and said axis of rotation being eccentrically disposed a substantial predetermined distance from said geometric center point to permit eccentric rotation of said first transmission gear wheel;

said second transmission gear wheel comprising:

a circular gear rim;

a geometric center point;

gear teeth being disposed on said circular gear rim of said second transmission gear wheel and being symmetrically disposed with respect to said geometric center point of said second transmission gear wheel;

an axis of rotation about which said second transmission gear wheel rotates;

said second transmission gear wheel being mounted at the axis of rotation of said second transmission gear wheel; and said axis of rotation of said second transmission gear wheel being eccentrically disposed a substantial predetermined distance from said geometric center point of said second transmission gear wheel to permit eccentric rotation of said second transmission gear wheel;

a drive gear wheel being connected coaxially to said second transmission gear wheel;

a toothed rack being engaged in mesh with said drive gear wheel and being operatively connected to said spring; and said first transmission gear wheel and said second transmission gear wheel being configured and disposed to permit the distance between the axis of rotation of said first transmission gear wheel and the axis of rotation of said second transmission gear wheel to remain substantially constant throughout the eccentric movement of said meshed, transmission gear wheels;

said gear teeth of each of said first transmission gear wheel and said second transmission gear wheel being disposed with respect to their corresponding axis of rotation to provide different mechanical advantages between said meshed, transmission gear wheels dependent upon the angular position of the connected pivot-hung door over the rotation of the connected pivot-hung door; and said first and second transmission gear wheels being configured and disposed to provide differences in the moments to the connected pivot-hung door dependent upon the angular position of the connected pivot-hung door over the rotation of the connected pivot-hung door, and to provide differences in the moments to said shaft dependent upon the angular position of the connected pivot-hung door over the rotation of the connected pivot-hung door.

2. The door closer according to claim 1, wherein:

each of said transmission gear wheels has a corresponding pitch circle;

the geometric center point of each of said transmission gear wheels is the center of its corresponding pitch circle; and said pitch circle of said first transmission gear wheel is disposed to intersect substantially tangentially with said pitch circle of said second transmission gear wheel throughout rotation of said meshed transmission gear wheels.

3. The door closer according to claim 2, wherein:

each of said transmission gear wheels has a standard gearing according to DIN 867; and the ratio of the magnitude of the eccentricity provided by the predetermined distance between the geometric center points and the axes of rotation to the base circle diameter is not substantially greater than 0.137 according to DIN 867.

4. The door closer according to claim 3, wherein:

said door closer comprises a top-mounted door closer; and said linkage comprises one of:

a slide-rail linkage; and a toggle-lever linkage.

5. The door closer according to claim 3, wherein:

said door closer comprises an underfloor door closer; and said linkage comprises a bearing to connect said shaft to the connected pivot-hung door.

6. A door closer for a connected pivot-hung door, said door closer comprising:

a spring being configured and disposed to store energy upon opening of a connected pivot-hung door;

said spring being configured to supply a closing force to close the connected pivot-hung door;

a transmission arrangement;

a linkage being configured to connect said transmission arrangement to the connected pivot-hung door and being configured to move the connected pivot-hung door;

said transmission arrangement being configured and disposed to connect said spring to said linkage to permit transfer of force from said linkage to said spring to store energy in said spring upon opening of the connected pivot-hung door, and to permit transfer of force from said spring to said linkage to move said linkage upon closing of the connected pivot-hung door; and said transmission arrangement comprising:

a shaft being connected to said linkage;

a first transmission gear wheel being connected coaxially to said shaft;

a second transmission gear wheel being engaged in mesh with said first transmission gear wheel substantially constantly throughout rotation of each of said transmission gear wheels;

said first transmission gear wheel comprising:

a geometric center point;

gear teeth being disposed on the periphery of said first transmission gear wheel and being symmetrically disposed with respect to said geometric center point;

an axis of rotation about which said first transmission gear wheel rotates;

said first transmission gear wheel being mounted at said axis of rotation; and said axis of rotation being eccentrically disposed a substantial predetermined distance from said geometric center point to permit eccentric rotation of said first transmission gear wheel;

said second transmission gear wheel comprising:

a geometric center point;

gear teeth being disposed on the periphery of said second transmission gear wheel and being symmetrically disposed with respect to said geometric center point of said second transmission gear wheel;

an axis of rotation about which said second transmission gear wheel rotates;

said second transmission gear wheel being mounted at the axis of rotation of said second transmission gear wheel; and said axis of rotation of said second transmission gear wheel being eccentrically disposed a substantial predetermined distance from said geometric center point of said second transmission gear wheel to permit eccentric rotation of said second transmission gear wheel;

a drive gear wheel being connected coaxially to said second transmission gear wheel;

a toothed rack being engaged in mesh with said drive gear wheel and being operatively connected to said spring; and said gear teeth of each of said first transmission gear wheel and said second transmission gear wheel being disposed with respect to their corresponding axis of rotation to provide different mechanical advantages between said meshed, transmission gear wheels dependent upon the angular position of the connected pivot-hung door over the rotation of the connected pivot-hung door; and said first and second transmission gear wheels being configured and disposed to provide differences in the moments to the connected pivot-hung door dependent upon the angular position of the connected pivot-hung door over the rotation of the connected pivot-hung door, and to provide differences in the moments to said shaft dependent upon the angular position of the connected pivot-hung door over the rotation of the connected pivot-hung door.

7. The door closer according to claim 6, wherein:

said transmission gear wheels are circular; and said first transmission gear wheel and said second transmission gear wheel being configured and disposed to permit the distance between the axis of rotation of said first transmission gear wheel and the axis of rotation of said second transmission gear wheel to remain substantially constant throughout the eccentric movement of said meshed, transmission gear wheels.

8. The door closer according to claim 7, wherein:

said door closer comprises a top-mounted door closer; and said linkage comprises one of:

a slide-rail linkage; and a toggle-lever linkage.

9. The door closer according to claim 8, wherein:

each of said transmission gear wheels has a corresponding pitch circle;

the geometric center point of each of said transmission gear wheels is the center of its corresponding pitch circle;

said pitch circle of said first transmission gear wheel is disposed to intersect substantially tangentially with said pitch circle of said second transmission gear wheel throughout rotation of said meshed transmission gear wheels;

each of said transmission gear wheels has a standard gearing according to DIN 867; and the ratio of the magnitude of the eccentricity provided by the predetermined distance between the geometric center points and the axes of rotation to the base circle diameter is not substantially greater than 0.137 according to DIN 867.

10. The door closer according to claim 7, wherein:

said door closer comprises an underfloor door closer; and said linkage comprises a bearing to connect said shaft to the connected pivot-hung door.

11. The door closer according to claim 10, wherein:

each of said transmission gear wheels has a corresponding pitch circle;

the geometric center point of each of said transmission gear wheels is the center of its corresponding pitch circle;

said pitch circle of said first transmission gear wheel is disposed to intersect substantially tangentially with said pitch circle of said second transmission gear wheel throughout rotation of said meshed transmission gear wheels;

each of said transmission gear wheels has a standard gearing according to DIN 867; and the ratio of the magnitude of the eccentricity provided by the predetermined distance between the geometric center points and the axes of rotation to the base circle diameter is not substantially greater than 0.137 according to DIN 867.

* * * * *

UNITED STATES PATENT AND TRADEMARK OFFICE

CERTIFICATE OF CORRECTION

PATENT NO. : 6,510,586 B1
DATED : January 28, 2003
INVENTOR(S) : Lothar Ginzel

It is certified that error appears in the above-identified patent and that said Letters Patent is hereby corrected as shown below:

Title page,
Item [56], U.S. PATENT DOCUMENTS, the sixth reference, delete "4,915,280" and insert -- 4,912,806 --.

Column 1,
Line 25, after "casing", delete "(came" and insert -- (case --.

Column 2,
Line 51, after "closer" delete "a".

Column 4,
Line 11, after "of" delete "-".
Line 19, after "centers" delete "-".
Line 49, after "28", delete "rotates" and insert -- rotate, --.

Column 6,
Line 30, after "Selbstaetiger", delete "Tuerachliesser" and insert -- Tuerschliesser --.

Column 8,
Line 19, after "magnitude", delete "a" and insert -- e --.

Signed and Sealed this

Twenty-fourth Day of June, 2003

JAMES E. ROGAN
*Director of the United States Patent and Trademark Office*